US011419363B2

(12) United States Patent
Senftleben et al.

(10) Patent No.: US 11,419,363 B2
(45) Date of Patent: Aug. 23, 2022

(54) CHILD-RESISTANT SMOKING ARTICLE PACKAGE

(71) Applicant: Fontem Holdings 1 B.V., Amsterdam (NL)

(72) Inventors: Sebastian Senftleben, Hamburg (DE); Thorben Rehders, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 509 days.

(21) Appl. No.: 16/074,749

(22) PCT Filed: Jan. 27, 2017

(86) PCT No.: PCT/EP2017/051782
§ 371 (c)(1),
(2) Date: Aug. 1, 2018

(87) PCT Pub. No.: WO2017/133982
PCT Pub. Date: Aug. 10, 2017

(65) Prior Publication Data

US 2019/0037917 A1 Feb. 7, 2019

(30) Foreign Application Priority Data

Feb. 5, 2016 (EP) ..... 16154462

(51) Int. Cl.

| | |
|---|---|
| ***B65D 85/10*** | (2006.01) |
| ***A24F 15/01*** | (2020.01) |
| ***A24F 15/20*** | (2006.01) |
| *B65D 50/04* | (2006.01) |

(52) U.S. Cl.
CPC ..... *A24F 15/01* (2020.01); *A24F 15/20* (2013.01); *B65D 85/10* (2013.01); *B65D 50/043* (2013.01)

(58) Field of Classification Search
CPC ..... A24F 15/20; A24F 47/008; B65D 85/10; B65D 50/043; B65D 51/2807; B65D 51/2821; B65D 85/1009
USPC ..... 206/254, 817; 220/522, 521, 23.88, 220/23.87, 23.86, 23.83
See application file for complete search history.

(56) References Cited

U.S. PATENT DOCUMENTS

| | | | | |
|---|---|---|---|---|
| 1,945,805 A | | 2/1934 | Fitz Gerald | |
| 2,981,435 A | * | 4/1961 | McCarthy | B65D 51/28 220/522 |
| 3,084,788 A | * | 4/1963 | Ford | D04B 3/00 206/383 |

(Continued)

FOREIGN PATENT DOCUMENTS

| | | |
|---|---|---|
| CN | 1756715 A | 4/2006 |
| CN | 101873979 A | 10/2010 |

(Continued)

*Primary Examiner* — Steven A. Reynolds
(74) *Attorney, Agent, or Firm* — Dykema Gossett PLLC

(57) ABSTRACT

Provided is a child-resistant smoking article package (100) including a case (110) with an opening (112), a child-resistant closure (120) for closing the opening (112) of the case (110), and a smoking article holder (130) provided inside the case (110). The smoking article holder (130) is coupled to the closure (120), wherein the smoking article holder (130) comprises at least one storage compartment (132) configured to receive a smoking article (136) therein.

13 Claims, 10 Drawing Sheets

(56) References Cited

U.S. PATENT DOCUMENTS 3,860,136 A * 1/1975 Romney ..... B65D 41/06 215/222
4,350,171 A * 9/1982 Kemmel ..... A24F 15/06 131/234
5,794,771 A * 8/1998 Krawec ..... A24F 23/00 206/223
6,213,777 B1 * 4/2001 Seitzinger ..... A61C 17/036 206/63.5
6,595,655 B2 * 7/2003 Neeb ..... F41B 5/06 206/315.1
7,510,094 B1 * 3/2009 Willis ..... B65D 50/043 215/218
8,757,413 B1 * 6/2014 Kephart ..... B62J 9/22 220/23.83
9,932,217 B2 * 4/2018 Perrelli ..... G06F 19/3475
2009/0178573 A1 * 7/2009 Pan ..... A47J 31/20 99/323
2009/0272747 A1 * 11/2009 Kalaouze, Jr. ..... B65D 81/3222 220/500
2014/0216961 A1 * 8/2014 Liu ..... A24F 15/12 206/266
2015/0216230 A1 8/2015 Loos et al.
2015/0291312 A1 * 10/2015 Kalagher ..... B65D 81/3227 215/6
2018/0310613 A1 * 11/2018 Simon ..... A24F 21/00

FOREIGN PATENT DOCUMENTS

| | | | |
|---|---|---|---|
| CN | 102438921 | A | 5/2012 |
| CN | 103384631 | A | 11/2013 |
| CN | 103501847 | A | 1/2014 |
| CN | 103767078 | A | 5/2014 |
| CN | 203913380 | U | 11/2014 |
| CN | 204056660 | U | 12/2014 |
| CN | 204332716 | U | 5/2015 |
| CN | 204362978 | U | 6/2015 |
| CN | 204466912 | U | 7/2015 |
| CN | 204540816 | U | 8/2015 |
| CN | 204599325 | U | 9/2015 |
| CN | 204599326 | U | 9/2015 |
| EP | 2580134 | | 4/2013 |
| EP | 2904914 | A1 | 12/2015 |
| GB | 15828 | | 4/1915 |
| WO | 2011154822 | A1 | 12/2011 |
| WO | 2014195859 | A2 | 12/2014 |

* cited by examiner

CHILD-RESISTANT SMOKING ARTICLE PACKAGE

CROSS-REFERENCE TO RELATED APPLICATIONS

This application is a national stage application of International patent application No. PCT/EP2017/051782, filed 27 Jan. 2017 and published under International publication No. WO/2017/133982 on 10 Oct. 2017 (the '782 application). This application claims priority to European patent application No. 16154462.2, filed 5 Feb. 2016 and published under European publication No. EP3202271 on 9 Aug. 2017 (the '462 application). The '782 application and the '462 application are each hereby incorporated by reference as though fully set forth herein.

FIELD OF INVENTION

The present invention relates generally to a child-resistant smoking article package.

BACKGROUND OF THE INVENTION

Child-resistant packages are well known in the field of medicaments. The regulations for a package to be declared "child-resistant" or "child-safe" are defined by different international norms and standards. These regulations require that a package would have to successfully undergo a number of tests with actual groups of children in order to be officially declared child-resistant. In general, different safety elements are provided on a package which aim to delay the time until an unauthorised person, for instance a child, is able to open the package. This extra time should allow an authorized person to interfere with the unauthorized person before opening of the package is completed. For instance, U.S. Pat. No. 7,510,094 B1 discloses a child-resistant one piece push and turn closure. Thus, the term "child-resistant package" like it is used in the present application is to be understood as referring to a package which exhibits certain features for delaying access to the interior of the package.

An electronic smoking device on the other hand, such as an electronic cigarette (e-cigarette), typically has a housing accommodating an electric power source (e.g., a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor. An electronic cigarette can have replaceable parts like the liquid reservoir, the battery and the like. Therefore, a package is required to carry the different parts of an electronic cigarette.

SUMMARY OF THE INVENTION

In accordance with one aspect of the present invention there is provided a child-resistant smoking article package comprising a case with an opening, a child-resistant closure for closing the opening of the case, and a smoking article holder coupled to the closure. The smoking article holder comprises at least one storage compartment configured to receive a smoking article therein.

The smoking article holder is coupled to the closure such that when the closure is lifted off the case, the holder is drawn out the case.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
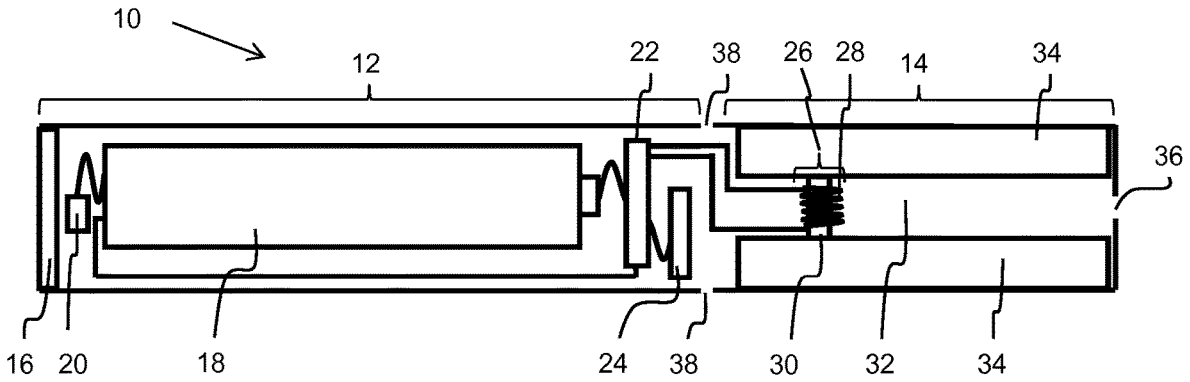
FIG. 1 is a schematic cross-sectional illustration of an exemplary e-cigarette.

Before describing the inventive package, first an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g., steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12.

The end cap 16 may be made from translucent plastic or other translucent material to allow a light-emitting diode (LED) 20 positioned near the end cap 16 to emit light through the end cap 16. The end cap 16 can be made of metal or other materials that do not allow light to pass.

An air inlet may be provided in the end cap 16, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil 28.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or may be formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette 10. The airflow sensor 24 may be replaced with a switch which enables a user to activate the e-cigarette 10 manually rather than in response to the detection of a change in air flow or air pressure.

Different types of atomizers may be used. Thus for example, the atomizer may have a heating coil 28 in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Thus, an electronic cigarette may comprise different separable and replaceable parts, like the power supply portion 12, the liquid reservoir 34, the atomizer 26, the heating coil 28 or the atomizer/liquid reservoir portion 14 or a separate mouthpiece as a part of the atomizer/liquid reservoir portion 14, or a atomizer/liquid reservoir unit to be replaced inside the atomizer/liquid reservoir portion 14 and various other parts.

Figure 2:
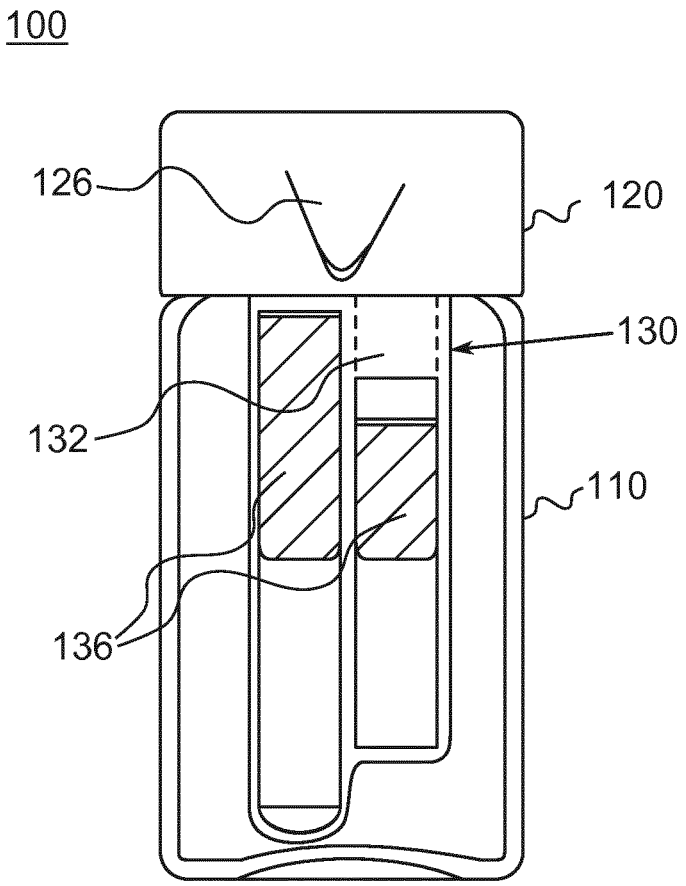
FIG. 2 is a schematic side view of an inventive child-resistant smoking article package.
Figure 3:
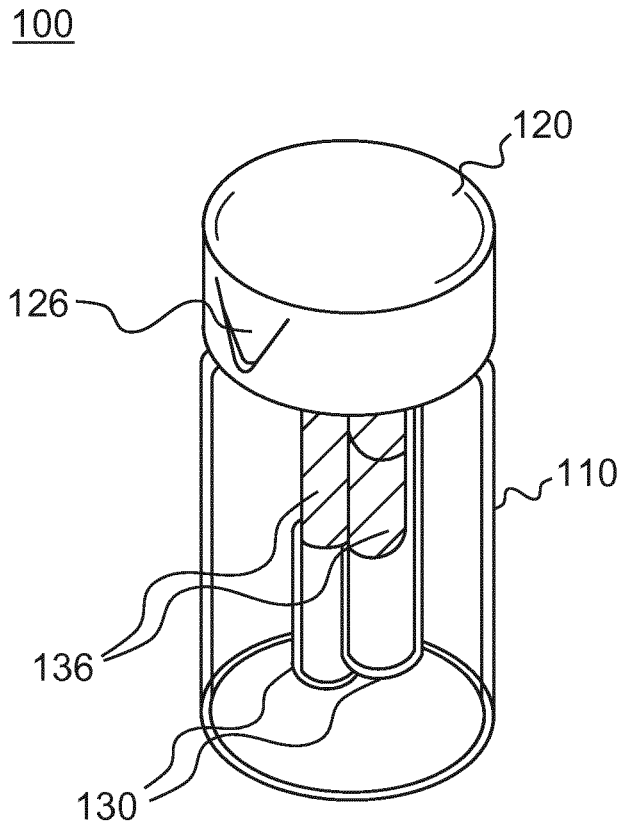
FIG. 3 is a schematic top/side view of an inventive child-resistant smoking article package.
Figure 4:
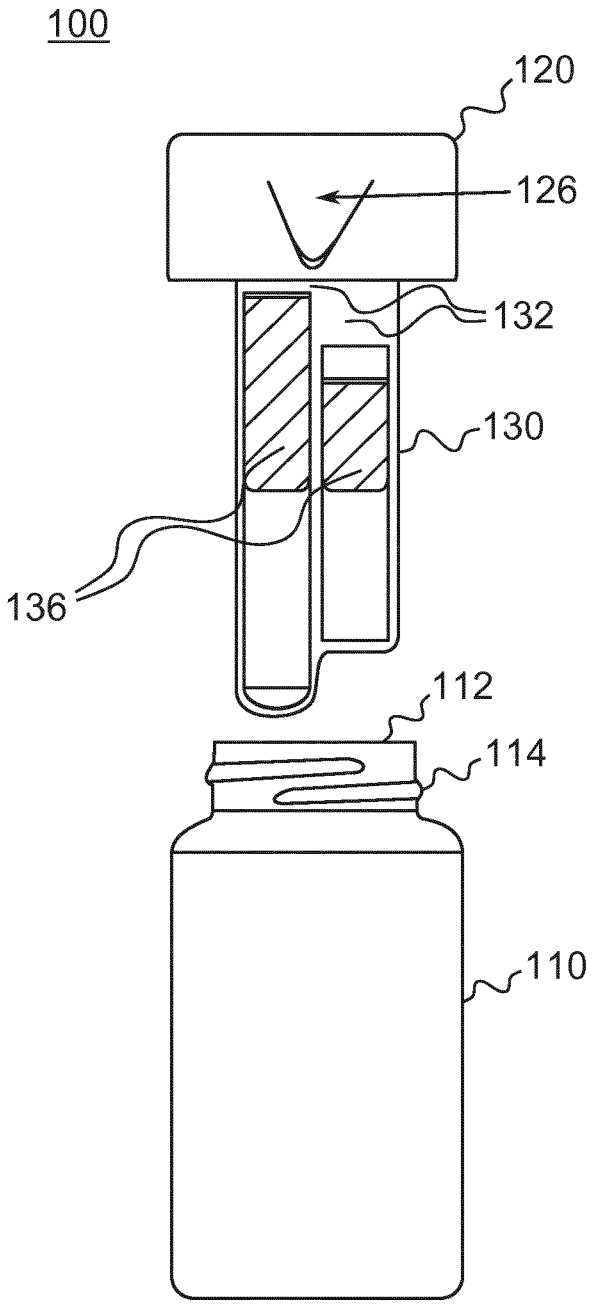
FIG. 4 is a schematic view of an inventive child-resistant smoking article package with the closure removed from the case.

FIG. 2 shows a package 100 for storing smoking articles therein. FIG. 3 is a schematic top-side view of an inventive child-resistant smoking article package, and FIG. 4 is a schematic view of an inventive child-resistant smoking article package with the closure removed from the case 110.

Throughout the present invention, the term "smoking articles" refers to a traditional cigarette or any of its parts like replaceable filters, or an electronic cigarette as described above, or any part of an electronic cigarette as described above, like the power supply portion 12, the liquid reservoir 34, the atomizer 26, the heating coil 28 or the atomizer/liquid reservoir portion 14, or a separate mouthpiece as a part of the atomizer/liquid reservoir portion 14, or a atomizer/liquid reservoir unit to be replaced inside the atomizer/liquid reservoir portion 14, a flavor compartment to add flavor to an electronic smoking article liquid and various other parts.

The inventive child-resistant smoking article package 100 comprises a case 110 with an opening 112 and a closure 120 for closing the opening 112 of the case 110. The closure 120 is thus removeably coupled to the case 110. The closure 120 is a child-resistant closure 120 with a press-section 126 such that the closure 120 can be removed from the case 110 by a simultaneous press action on the press-section 126 together with a rotating movement of the closure 120 with respect to the case 110. Such child-resistant closure function is known in the art. For the releasable engagement of the closure 120 to the case 110, the closure 120 may comprise a first closure female coupling unit 122 and the case 110 may comprise a corresponding, mating case male coupling unit 114 for engaging with the first closure female coupling unit 122. The closure 120 may be thread coupled to the case 110 or may comprise any other child-resistant coupling to the case 110. The shape of the press-section 126 in FIG. 2 is shown as a triangle but can have any other suitable shape.

Inside the case 110, a void is provided to receive a smoking article holder 130 therein. The inventive smoking article holder 130 is coupled to the closure 120 and not coupled to the case 110. In fact the holder 130 is provided spaced apart from the case 110 inside the case 110 and coupled or fixed to the closure 120, only.

The smoking article holder 130 comprises at least one storage compartment 132 configured to receive a smoking article 136 therein. As mentioned previously, a smoking article 136 may be any part of a conventional or an electronic smoking article such as an e-cigarette 10. In the non-binding example shown, the smoking article holder 130 stores and supports a cartomizer (left) and a battery (right) as smoking articles 130 therein.

The smoking article holder 130 is coupled to the closure 120 in such a way that when the closure 120 is lifted off the case 110, the holder 130 is drawn out of the case 110. Advantageously, the smoking articles 136 stored in the smoking article holder 130 are securely stored such that a transport protection of the inventive package 100 is achieved. Also, if the smoking article holder 130 is taken out of the case 110 along with the removal action of the closure 120 from the case 110, it is easy for the user to get access to the smoking articles 136 stored therein. The user does not need to perform the cumbersome steps of lifting-off the closure 120 from the case 110 first, putting it to a side, reaching into the case 110 to release the holder 130 from the case or to extract the smoking article 136 from the holder 130. Thus, the user experience becomes more comfortable.

The case 110 and the closure 120 as shown in the embodiments have a circular cross-section. However, the invention is not limited thereto. In fact, especially the holder 130 can have any suitable form for storing smoking articles 136 therein. The holder 130 as shown in FIGS. 2-4 has a non-uniform shape adapted to store different smoking articles 136 therein. Thus, the holder 130 comprises at least two different storage compartments 132 for storing a smoking article 136 therein. The holder 130 is preferably configured to hold a plurality of smoking articles 136, the smoking articles 136 taken from the group comprising a liquid reservoir 34, a battery 18, an atomizer 26, a mouthpiece, an atomizer/liquid reservoir portion 14, a heating coil 28, and any other part of a smoking article 136 such as an e-cigarette 10.

In one embodiment, the holder 130 is integrally formed with the closure 120. Preferably, in another embodiment, the holder 130 is releasable coupled to the closure 120. As a consequence, the holder 130 could be separately exchanged.

Figure 5:
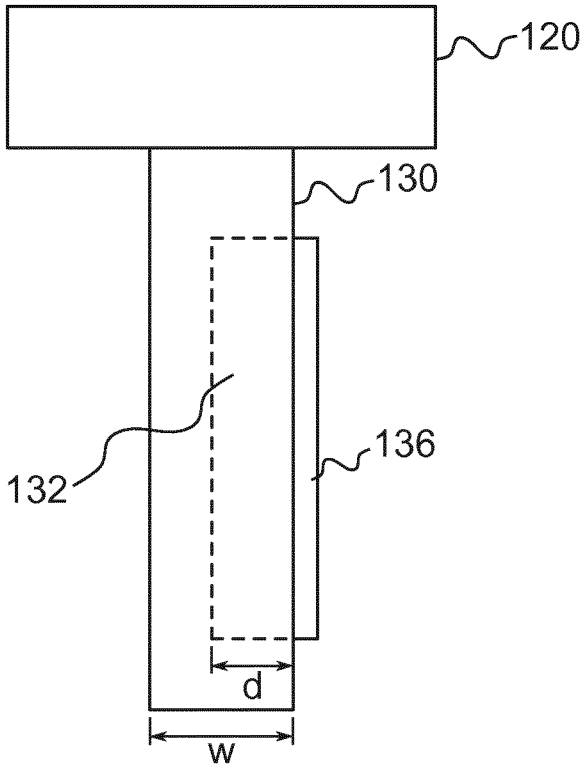
FIG. 5 is a schematic view of a closure with the smoking article holder attached thereto.

FIG. 5 is a schematic side view of a closure 120 with the smoking article holder 130 attached thereto. In the embodiment shown, the smoking article holder 130 has a closed surface on the left in FIG. 5 and an open surface on the right in FIG. 5. The smoking article 136 is placed in a storage compartment 132. The storage compartment 132 has a depth "d" smaller than the width "w" of the holder 130. The depth "d" is also smaller than the width of the smoking article 136 stored therein such that a surface of the smoking article 136 extends from surface of the holder 130 and the smoking article 136 can be easily accessed by a user and removed from the holder 130.

Figure 6:
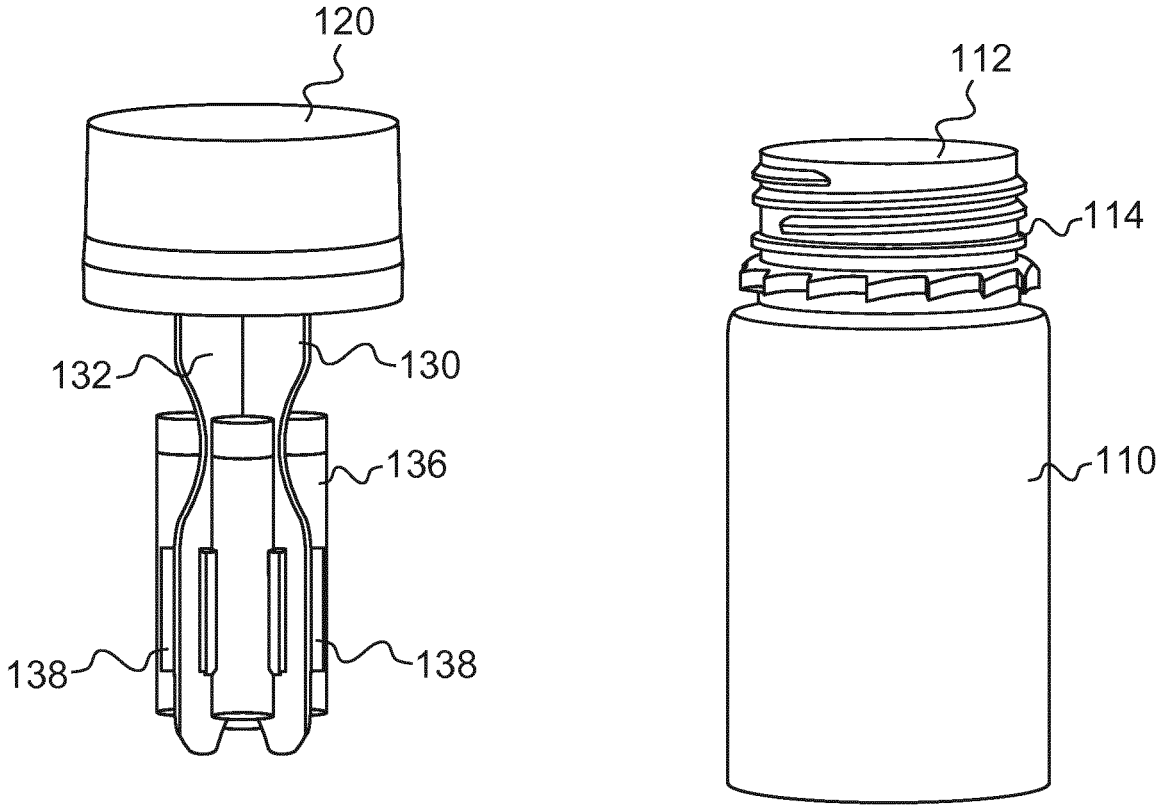
FIG. 6 is a schematic side view of a closure with the smoking article holder attached thereto and the case in a side view.

FIG. 6 shows a schematic side view of a closure 120 with the smoking article holder 130 attached thereto and the case 110 in a side view in another embodiment. Here, the storage compartments 132 of the holder 130 are provided on the periphery of a central section of the holder 130. The storage compartments 132 are provided on a circle around the vertical axis of the holder 130. The holder 130 is provided rotationally symmetric with respect to its vertical center axis. In the embodiment shown, four storage compartments 132 are provided. However, also two, three, five or other numbers of storage compartments 132 can be provided as long as they provide the space needed to store a smoking article 136 therein and to place the holder 130 into the case 110. The storage compartment 132 is provided with fixing elements 138. In the embodiment shown, the fixing elements 138 are flexible ribs into which the smoking articles 136 can be pressed to achieve a press-fit coupling. However, any other fixing elements 138 like hooks or the like can be used.

Figure 7:
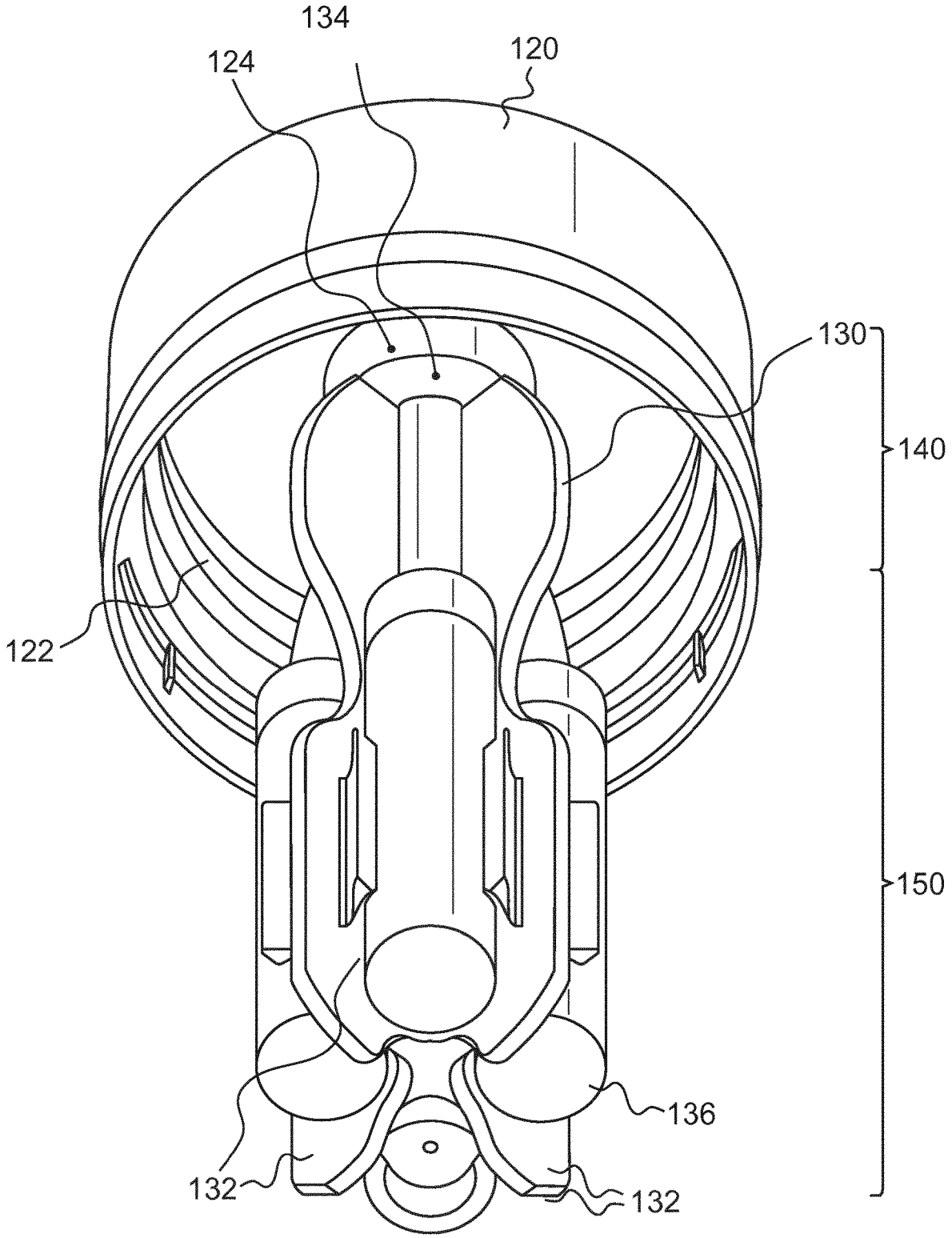
FIG. 7 is a schematic view of a closure with a smoking article holder from below.
Figure 8:
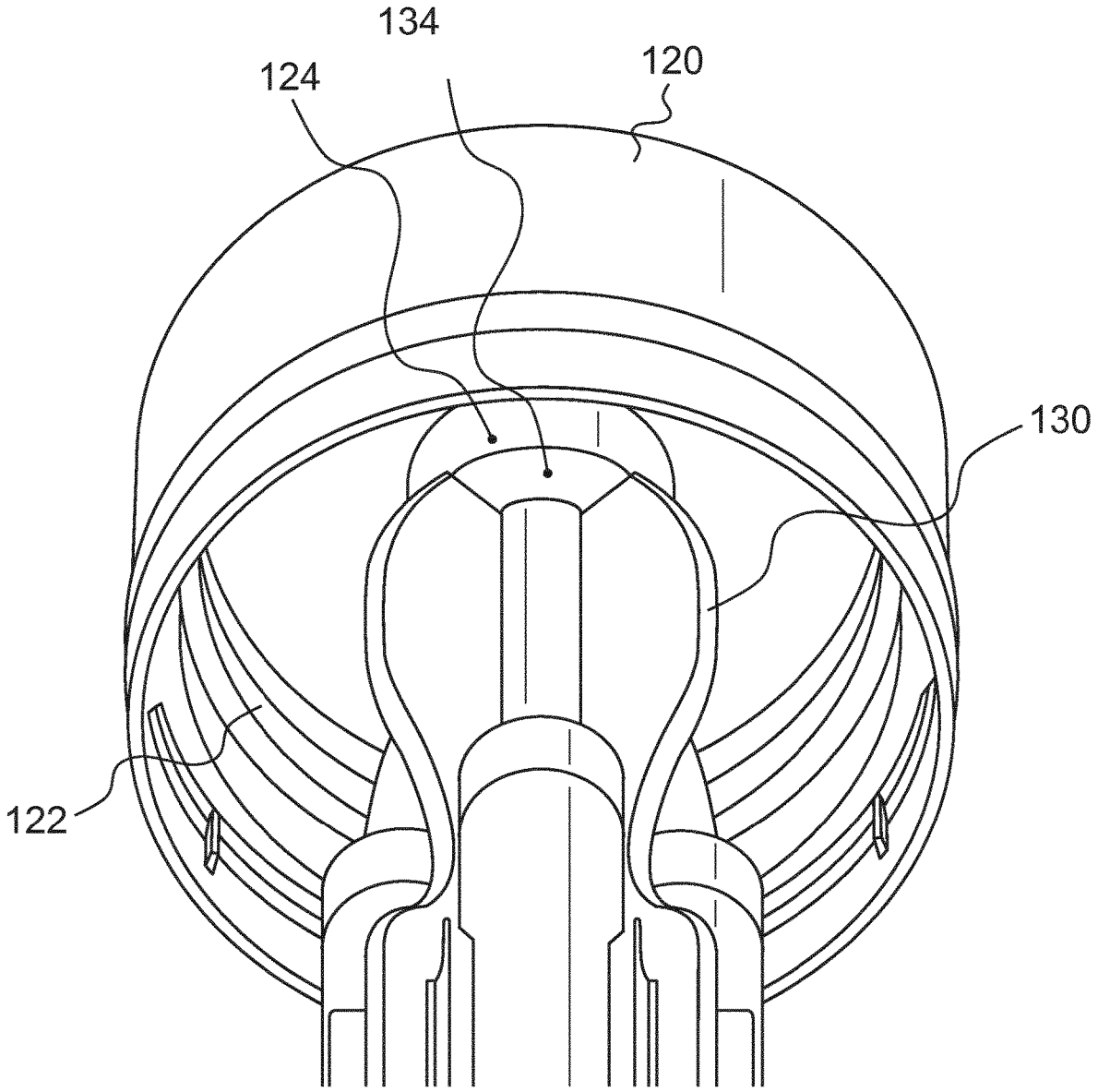
FIG. 8 is an enlarged view of the closure to smoking article holder coupling section.

FIG. 7 is a schematic view of the closure 120 with the smoking article holder 130 of FIG. 6 from below, and FIG. 8 is an detailed view of the closure coupled to the smoking article holder 130 of FIG. 7. For coupling the holder 130 to the closure 120, the closure 120 is provided with a second closure female coupling unit 124, i.e., a closure-to-holder female coupling unit 124. The holder 130 has a corresponding holder male coupling unit 134. In the embodiment shown, both coupling units 124, 134 have a circular cross section and the holder coupling unit 134 is pressed into the closure coupling unit 124 to achieve a press-fit seat. However, also a coupling via threads, hooks and corresponding protrusions or any other releasable and mating coupling units can be used. The closure 120 is further provided with the previously discussed first closure female coupling unit 122, provided on its inner circumference to engage with the case 110. In the embodiment shown, the coupling of the case 110 and the closure 120 is achieved via a threaded coupling. The cross section of the closure-to-holder female coupling unit 124 has a smaller cross section than the closure 120 itself. The holder 130 comprises a closure coupling section 140 and a smoking article storage section 150. The smoking article storage section 150 is provided below the closure coupling section 140.

Figure 9:
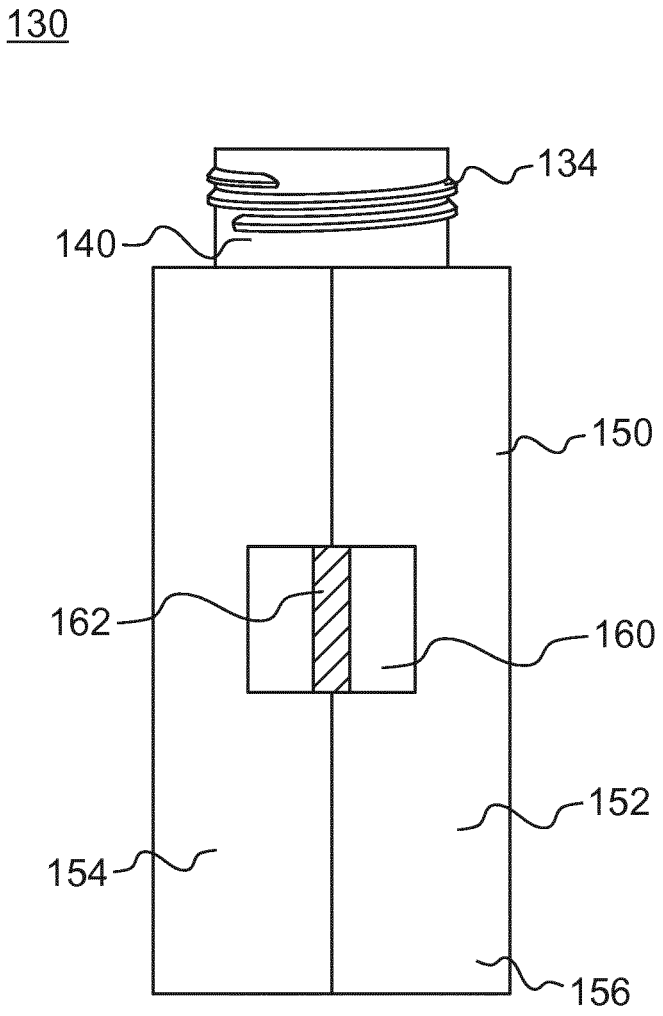
FIG. 9 is a schematic view of the smoking article holder in one embodiment.

In the previous embodiments shown, the smoking article holder 130 has an open structure such that the smoking articles 136 can be directly accessed when the closure 120 is removed from the case 110. FIG. 9 shows a schematic side view of another embodiment of the holder 130 of the invention. The smoking article storage section 150 is provided with an outer cover 156 divided into at least two parts, a first storage part 152 and a second storage part 154. The first and second storage section part 152, 154 are configured to be at least partially separable from each other. In other words, the first and second storage parts 152, 154 of the holder 130 are releasable coupled to each other via a first and second storage part coupling unit 160. In the embodiment shown, the first and second storage parts 152, 154 of the holder 130 are coupled to each other by at least one hinge 162. The hinge 162 is pivotally coupled to the first and second storage parts 152, 154, such that the first and second storage part 152, 154 can be opened on the opposing side of the hinge 162 and the smoking articles 136 stored therein can be accessed. On the interior, the smoking article holder 130 may have the same shape as discussed in the previous embodiments. The smoking article holder 130 can have a rotational symmetry with respect to its vertical center axis. The closed outer surface 156 of the smoking article storage section 150 provides better protection to the smoking articles 136 stored therein.

Of course, the embodiment of the first and second storage part coupling unit 160 is not limited to hinges 162, but can have any other shape or function suitable for coupling different parts to each other, like hooks and corresponding protrusions, bolts, nuts etc. Also, the first and second parts 152, 154 can be provided fully separable from each other and/or also separable from the holder 130. This would allow the user to choose whether an extra protection by the additional outer cover 156 is needed, e.g., during travel, or not.

The closure 120, the holder 130, the case 110 may all be formed separately by injection molding or thermoforming. Thus, they may be formed of plastic. Also, the first and second storage parts 152, 154 of the holder 130 may each be formed by injection molding or thermoforming. However, the invention is not limited thereto. When an expensive look of the package 100 may be required, at least the holder 130 could also be formed from stainless steel or the like.

Also, the at least one storage compartment 132 may be formed in just one of the first and second storage parts 152, 154 of the holder 130. Further, more than two parts may be provided or a door may be provided in an otherwise closed outer cover 156 of the smoking article storage section 150.

Figure 10:
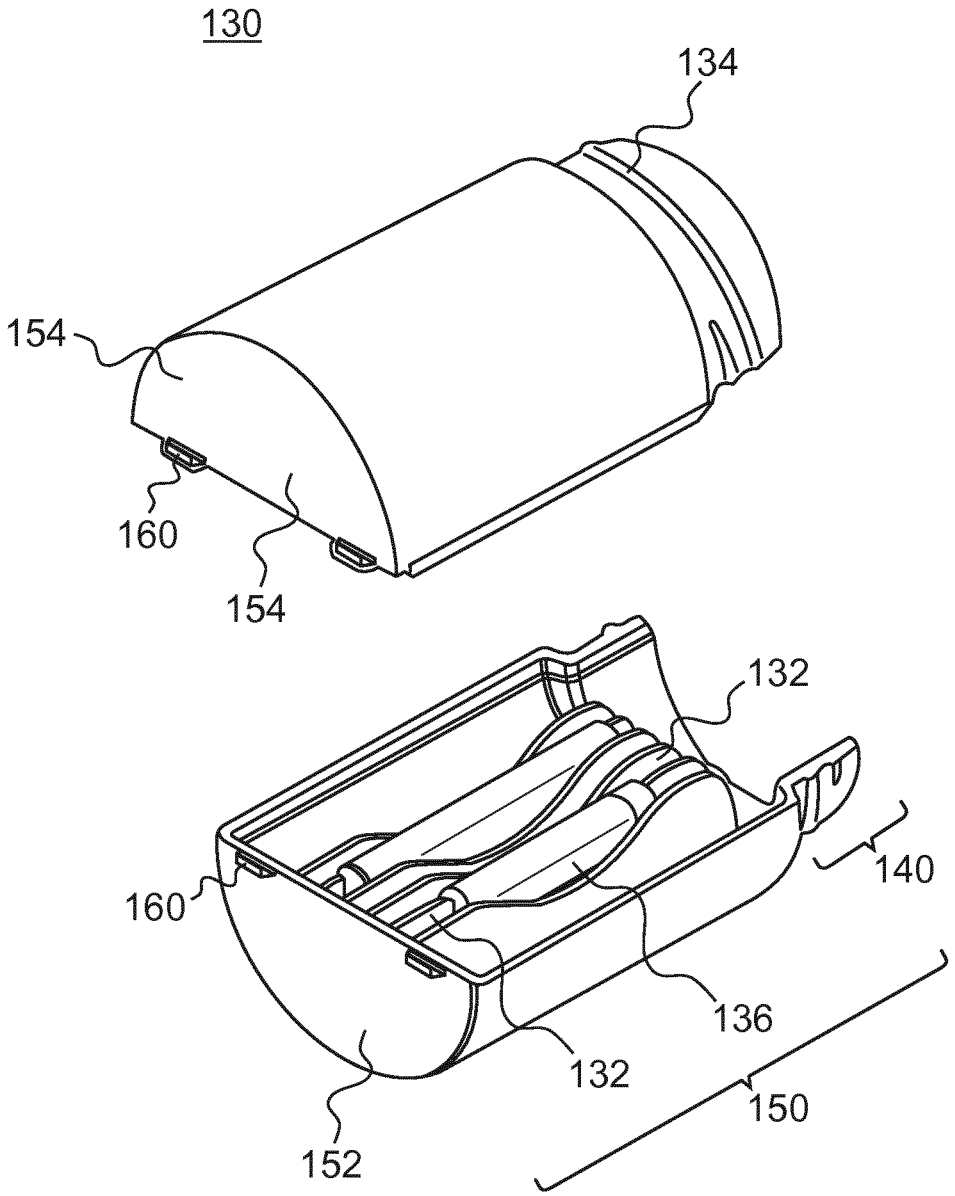
FIG. 10 is a schematic view of a smoking article holder in another embodiment.

As shown in FIG. 10, also the storage compartments 132 can be integrally formed in the interior of the outer cover 156 of the holder 130. This could be done by injection molding. In the embodiment shown, the first and second storage part coupling unit 160 is provided by hooks 160 attached to one of the first and second part 152, 154 and engaging into corresponding protrusions provided on the other part 152, 154. Thus, the holder 130 can mimic the shape of a bottle placed into another case 110, which could also have the shape of a bottle, for achieving additional protection.

In summary, in one aspect the child-resistant smoking article package comprises a case with an opening, a child-resistant closure for closing the opening of the case, a smoking article holder provided inside the case. The smoking article holder is coupled to the closure, wherein the smoking article holder comprises at least one storage compartment configured to receive a smoking article therein.

Advantageously, through the given configuration, the smoking article holder is coupled to the closure such that when the closure is lifted off the case, the holder is drawn out of the case and the stored smoking articles can be taken out from the holder.

The holder is configured to hold a plurality of smoking articles, the smoking articles taken from the group comprising a liquid reservoir, a battery, an atomizer, a mouthpiece, an atomizer-liquid reservoir portion, and a heater. In fact, the holder can be configured to hold any part and/or different parts of a smoking article.

The closure is releasable from the case by a simultaneous press and rotation action. In an embodiment, the holder is integrally formed with the closure. In an embodiment, the holder is releasable coupled to the closure.

The holder can be provided with a male coupling unit and the closure can be provided with a corresponding female coupling unit such that the male coupling unit of the holder can be releasable coupled to the female coupling unit of the closure.

The holder may comprise at least two differently dimensioned storage compartments, each compartment configured to store a smoking article therein.

The holder may comprise a closure coupling section coupled to the closure and a smoking article storage section for storing the smoking articles therein. The smoking article storage section may comprise at least one storage compartment.

The smoking article storage section comprises a first and a second storage section part configured to be separable from each other at least in part. The first and second storage parts of the holder may be releasable coupled to each other. The first and second storage parts of the holder may be coupled to each other by at least one hinge, or by hooks and corresponding protrusions.

The first and second storage parts of the holder may each formed by injection molding.

The at least one storage compartment may be formed in just one of the first and second storage parts of the holder.

The holder is provided such that it is spaced apart from and not in contact with the case.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir

36 air inhalation port
38 air inlets
100 package
110 case
112 opening
114 case male coupling unit
120 closure
122 first closure female coupling unit
124 second closure female coupling unit
126 press-section
130 holder
132 storage compartment
134 holder male coupling unit
136 smoking article
138 fixing element
140 closure coupling section
150 smoking article storage section
152 first storage part
154 second storage part
156 outer cover of the smoking article storage section
160 first and second storage part coupling unit
162 hinge

The invention claimed is:

1. A child-resistant smoking article package comprising:
a case with an opening,
a child-resistant closure for closing the opening of the case,
a smoking article holder provided inside the case,
wherein
the smoking article holder is coupled to the closure, and wherein the smoking article holder comprises at least one storage compartment configured to receive a smoking article therein;
wherein the smoking article holder is provided such that it is spaced apart from and not in contact with the case when the closure is coupled to the case; and
wherein the closure is releasable from the case by a simultaneous press and rotation action.

2. The package of claim 1, wherein the smoking article holder is coupled to the closure such that when the closure is lifted off the case, the smoking article holder is drawn out of the case.

3. The package of claim 1, wherein the smoking article holder is configured to hold a plurality of smoking articles, and wherein the plurality of smoking articles comprises at least one of a liquid reservoir, a battery, an atomizer, a mouthpiece, an atomizer/liquid reservoir portion, and a heating coil.

4. The package of claim 1, wherein the smoking article holder is integrally formed with the closure.

5. The package of claim 1, wherein the smoking article holder is releasably coupled to the closure.

6. The package of claim 5, wherein the smoking article holder includes a male coupling unit and the closure includes a corresponding female coupling unit such that the male coupling unit of the holder can be releasably coupled to the female coupling unit of the closure.

7. The package of claim 1, wherein the smoking article holder comprises at least two differently dimensioned storage compartments, each storage compartment configured to store a smoking article therein.

8. The package of claim 1, wherein the smoking article holder comprises a closure coupling section and a smoking article storage section.

9. The package of claim 8, wherein the smoking article storage section comprises a first storage part and a second storage part, the first and second storage parts being configured to be separable from each other at least in part.

10. The package of claim 9, wherein the first and second storage parts of the smoking article holder are releasably coupled to each other.

11. The package of claim 9, wherein the first and second storage parts of the smoking article holder are coupled to each other by at least one hinge.

12. The package of claim 9, wherein the first and second storage parts of the smoking article holder are each formed by injection moulding or thermoforming.

13. The package of claim 9, wherein the at least one storage compartment is formed in just one of the first and second storage parts of the smoking article holder.

* * * * *